US006390191B1

(12) United States Patent
Melson et al.

(10) Patent No.: US 6,390,191 B1
(45) Date of Patent: May 21, 2002

(54) METHOD FOR STIMULATING HYDROCARBON PRODUCTION

(75) Inventors: Arthur F. Melson, Plano, TX (US); David C. Steere, Panama City Beach, FL (US)

(73) Assignee: Ultram Well Stimulation and Servicing, Inc., Panama City Beach, FL (US)

( * ) Notice: Subject to any disclaimer, the term of this patent is extended or adjusted under 35 U.S.C. 154(b) by 0 days.

(21) Appl. No.: 09/617,001

(22) Filed: Jul. 14, 2000

Related U.S. Application Data

(60) Provisional application No. 60/144,860, filed on Jul. 20, 1999.

(51) Int. Cl.[7] ..... E21B 28/00

(52) U.S. Cl. ..... 166/177.1; 166/177.6; 166/66.4; 166/249

(58) Field of Search ..... 166/177.1, 177.6, 166/249, 66.4

(56) References Cited

U.S. PATENT DOCUMENTS

| | | | | |
|---|---|---|---|---|
| 3,322,196 A | * | 5/1967 | Bodine, Jr. | 166/177.1 |
| 3,583,677 A | * | 6/1971 | Phillips | 259/1 |
| 4,280,558 A | | 7/1981 | Bodine | 166/245 |
| 4,343,356 A | | 8/1982 | Riggs et al. | 166/60 |
| 4,417,621 A | | 11/1983 | Medlin et al. | 166/249 |
| 4,437,518 A | | 3/1984 | Williams | 166/248 |
| 4,512,402 A | * | 4/1985 | Kompanek et al. | 166/249 |
| 4,537,256 A | | 8/1985 | Beard | 166/299 |
| 4,788,467 A | * | 11/1988 | Plambeck | 310/323 |
| 5,109,922 A | * | 5/1992 | Joseph | 166/65.1 |
| 5,595,243 A | | 1/1997 | Maki, Jr. et al. | 166/177.2 |
| 5,826,653 A | | 10/1998 | Rynne et al. | 166/245 |
| 5,836,389 A | | 11/1998 | Wagner et al. | 166/249 |

* cited by examiner

*Primary Examiner*—David Bagnell
*Assistant Examiner*—Daniel P. Stephenson
(74) *Attorney, Agent, or Firm*—William B. Noll

(57) ABSTRACT

A system for stimulating the production of hydrocarbon containing substances, such as from oil and gas wells, by the use of a generally cylindrical, high energy producing transducer mechanism. The transducer comprises a series of aligned transducer elements, preferably formed of doped ceramic piezoelectric materials, encased in a housing maintained under controlled pressure by a pressure compensator to equalize the pressure within the housing to that of the surrounding strata containing the hydrocarbon substance. When energized, the respective transducer elements transmit a very narrow, horizontal beam of ultrasonic energy radiating omni directionally, preferably in a narrow band of about 2 to 3°, to thereby focus the energy horizontally for maximum penetration into the surrounding strata.

9 Claims, 2 Drawing Sheets

METHOD FOR STIMULATING HYDROCARBON PRODUCTION

RELATED APPLICATION

This application is based on the priority document, Provisional Application, Serial No. 60/144,860, filed Jul. 20, 1999, and entitled "Method and Apparatus for Stimulating Hydrocarbon Production," by the inventors hereof.

FIELD OF THE INVENTION

This invention is directed to the field of downwell hydrocarbon production, such as oil and gas, more particularly to the use of high energy ultrasonics, as the means to stimulate the hydrocarbon containing strata surrounding a well casing for its eventual recovery.

BACKGROUND OF THE INVENTION

The present invention relates to a system, preferably in the form of a method, to stimulate hydrocarbon flow from wells whose production has been reduced to marginal or entirely unfeasible. The recognition that such wells may still contain a significant pool of oil, for example, has prompted many in the oil industry to investigate economical ways to stimulate production from such wells. A typical correction for such a well is to apply a fracture, also called a "frac. " A frac consists of introducing a foreign substance, such as water, steam or inert gas to the well casing under pressure. The pressurized gas or liquid exits the casing through the perforations and actually breaks up obstructions to the flow of hydrocarbons and affects the geological formation in the vicinity of the well. When the frac pressure is released, the well must be cleaned, usually by swabbing, and the foreign substance is pumped out or removed under natural pressure for disposal. When the well has stabilized, an increased flow of liquid and gas from the well can result.

The prior art, as reflected in the following U.S. Patents, has offered a number of different approaches to the conventional frac method:

a.) U.S. Pat. No. 5,836,389, to Wagner et al., teaches an oil recovery system utilizing an impulse wave device to produce impulse waves which travel down-hole and strike a bridge plug. When the impulse waves strike the bridge plug, weak elastic waves are created. After creation, the weak elastic waves propagate in all directions. The weak elastic waves are maintained in a general area near an oil formation by a conventional packer and a diffuser/deflector.

b.) U.S. Pat. No. 5,826,653, to Rynne et al., is directed to a method which employs multiple sources of acoustical power in an array about and spaced-apart from the surface, and directing a volume of acoustical excitation from the sources into the region containing the material to be recovered.

c.) U.S. Pat. No. 4,537,256, to Beard, relates to a sonic fracing process that uses sonic waves to crack and loosen the interstices of the oil and gas formation.

d.) U.S. Pat. No. 4,437,518, to Williams, teaches a recovery system that uses an excitation apparatus lowered through the casing of an oil well until it is submerged in oil. The apparatus includes a gas discharge tube which emits radiation, either ultraviolet or infra-red, into the surrounding oil. Next, another section of the excitation apparatus provides a mechanical energy input to the oil. The effect is to increase the pressure within the well and to cause the oil to flow more freely, thereby markedly increasing the productivity of the well after the treatment has been completed.

e.) U.S. Pat. No. 4,417,621, to Medlin et al., is directed to a method for recovering oil from a subterranean, viscous oil-containing formation by injecting a gaseous driving fluid such as carbon dioxide into the formation and recovering oil therefrom while simultaneously transmitting vibrations in the seismic frequency range having an amplitude not exceeding 100 Angstrom units through the formation which enhances the flow of the carbon dioxide and thereby increases the efficiency of recovering the oil.

f) U.S. Pat. No. 4,343,356, to Riggs et al., relates to a system for the stimulation of fluid flow from a sub surface formation by the creation of a plasma region, or shock wave such as by electrical discharge, to ionize and gasify the material for recovery.

While the above prior art offers different approaches to the achieving improved well production, only U.S. Pat. No. 5,595,243, to Maki, Jr. et al., suggests the use of transducers as a means to stimulate by the use of ultrasonic waves. This patent discloses a method and apparatus for cleaning the wellbore and the near wellbore region. A sonde is provided which is adapted to be lowered into a borehole and which includes a plurality of acoustic transducers arranged around the sonde. Electrical power provided by a cable is converted to acoustic energy. The high intensity acoustic energy directed to the borehole wall and into the near wellbore region, redissolves or resuspends the material which is reducing the permeability of the formation and/or restricting flow in the wellbore.

The present invention differs from the prior arts procedures described above by the provision of a high powered, ultrasonic system for stimulating the flow of hydrocarbon products, such as gas and oil, from low or non producing wells, where the system hereof is ecologically friendly. The manner by which the present invention achieves these goals will become apparent from the following description, particularly when read in conjunction with the accompanying drawings.

SUMMARY OF THE INVENTION

The invention relates to a system for stimulating hydrocarbon production, such as from low producing wells, including a unique means to effect the stimulation. The process of the system comprises the steps of lowering a high powered, tuned transducer assembly down a well casing about which stimulation of the surrounding strata is desired. As the transducer assembly reaches the desired depth, the assembly is energized to cause sonic waves to extend laterally therefrom omni-directionally in a very narrow beam focused on the horizontal direction. The excitation causes three simultaneous effects: liquid degassing, cavitation, and breaking of cohesion bonds. The combined effect is to release the hydrocarbon, such as oil and/or gas, and effect a normal or enhanced flow from the well. The process has ecological benefits as no foreign substances need to be added to the well, and since the sonic waves pass unimpeded through the well casing, the process may be used with old wells that have deteriorated over the years, which would otherwise be damaged by conventional fracing procedures.

The transducer assembly is a sealed housing containing a plurality of aligned, cylindrical, piezoelectric members, spaced apart by non conductive spacer elements. The respective piezoelectric members and spacer elements are encased in a high viscous oil medium, such as castor oil, where the oil medium is in communication with a pressure compensator to adjust the pressure of the oil medium with to be equal to the surrounding environment. As part of the energizing mechanism, the scaled housing includes a transformer section in electrical communication with an above ground power source. The purpose of the transformer is two fold: (a) step up the voltage on the transmission line, and (b) match the transducer impedance to the characteristic impedance of the transmission line (50±j0 Ω).

Accordingly, an object of this invention is the provision of an effective, ecologically friendly system to stimulate oil or gas production from low producing wells, for example.

Another object hereof is the use of a piezoelectric, transducer assembly, engineered to emit sonic waves throughout 360 degrees about the assembly, along a narrow, horizontal beam of about 2 to 3°.

These and other objects will become more apparent to those skilled in the art from the following specification.

DETAILED DESCRIPTION OF PREFERRED EMBODIMENT

Figure 1:
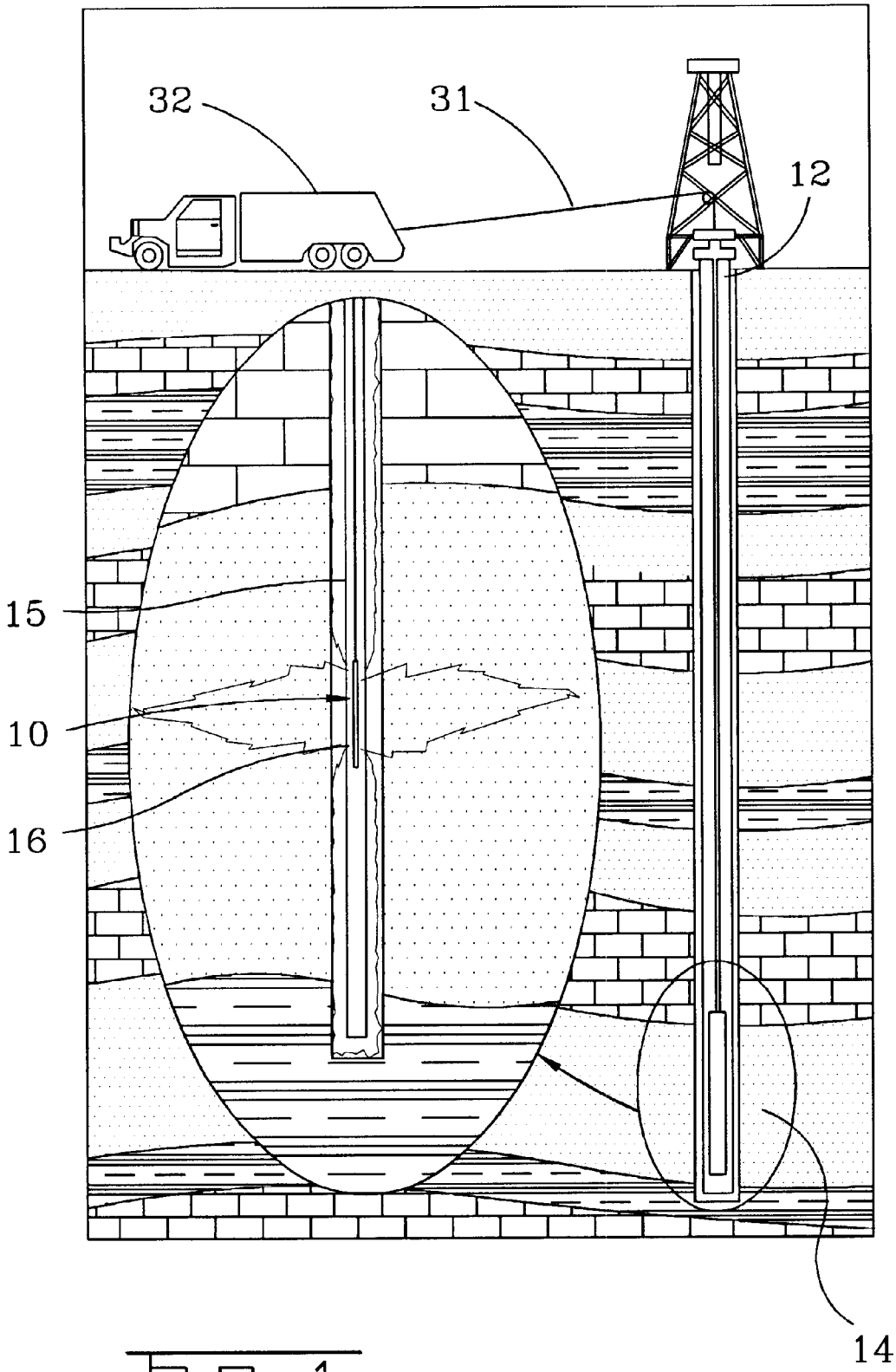
FIG. 1 is a simplified representation of a downhole well, into which the transducer assembly of this invention has been lowered to a position to effect a stimulation of the flow of hydrocarbons from the surrounding strata, including an enlarged representation of the energized transducer assembly hereof, illustrating the ultrasonic radiation pattern of the assembly.

The present invention is directed to a system, principably in the form of a method, for stimulating hydrocarbon, i.e. oil and gas, production from a downhole well, where the system utilizes a high powered, ultrasonic transducer assembly to effect the stimulation through liquid gassification, cavitation, and breaking of cohesion bonds, of the affected strata surrounding the well. The invention can best be described with regard to the several Figures, where, like reference numerals represent like components or features throughout the various views.

FIG. 1 illustrates in general, but simplified for purposes of understanding, the operation of the transducer assembly 10 of this invention, and its relationship to a downhole well 12, and hydrocarbon bearing strata 14 thereabout, where an exemplary well casing 15 has an I.D. of about 4¼" and includes plural perforations 16 in communication with the potential hydrocarbon producing strata 14. However, the operation of the system of this invention may be best understood by first considering the construction and operation of the transducer assembly 10.

Figure 3:
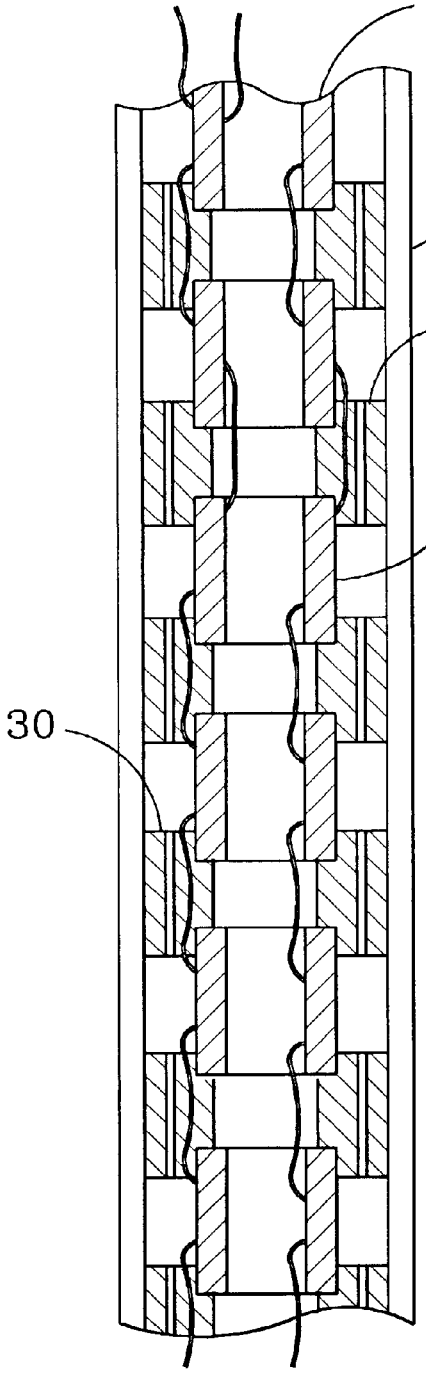
FIG. 3 is a partial sectional view illustrating details of the transducer section of the transducer assembly.
Figure 2:
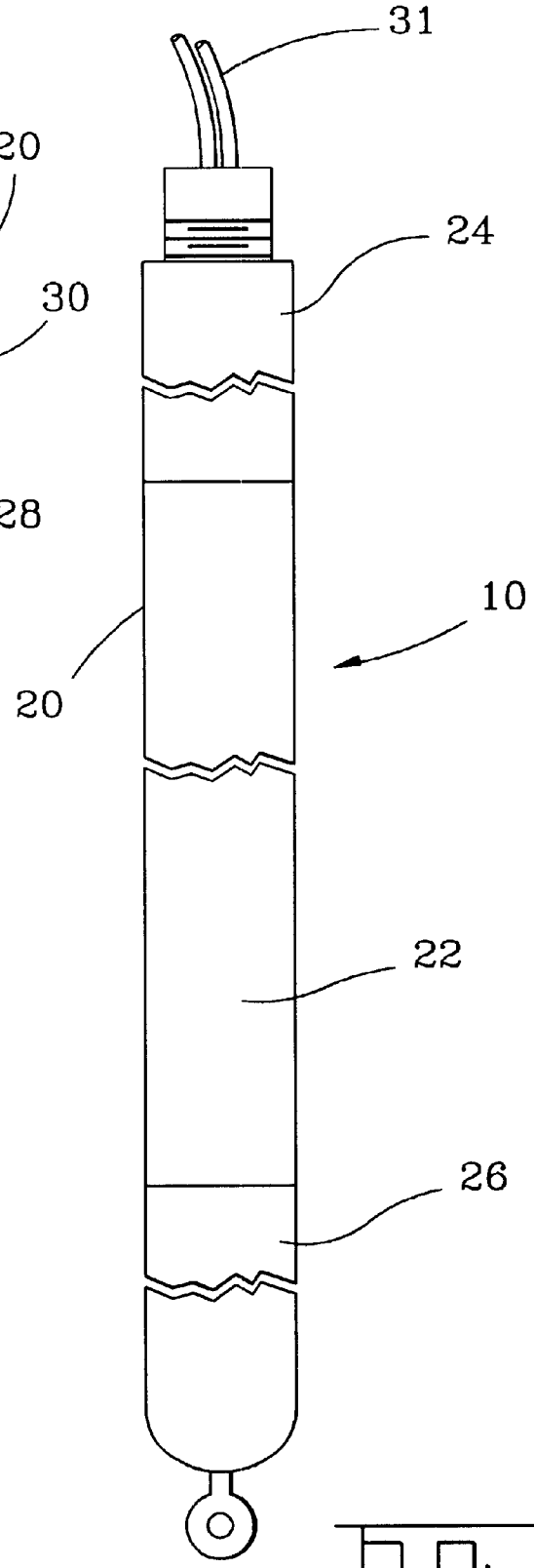
FIG. 2 is an enlarged plan view of the transducer assembly of this invention, where said assembly includes an intermediate transducer section between a transformer section and a pressure compensator section.

The transducer assembly 10, illustrated in FIGS. 2 and 3, is a piezoelectric device that operates at a high frequency, on the order of 20 kHz. Piezoelectricity is a phenomenon that has been known for years and can be found with products which occur in nature. Exerting pressure on certain naturally occurring crystals, such as quartz, or man made products, such as doped ceramics, can effect internal activity within the crystals or products. In many substances, the atoms are in the form of ions which are held together very tightly by their electric charges. Pressing the substances displaces the ions so that negative ions move toward one side of the substance, and positive ions toward the other. The reverse can happen too. Applying an electric signal to the piezoelectric substance makes it vibrate at a precise natural frequency. A well known device for the latter phenomenon, is a quartz oscillator, such as may be used in a clock or watch. With the development of piezoelectric ceramics, higher and more powerful vibrating devices became a reality, making possible the development of the transducer assembly of this invention.

The transducer assembly 10 comprises a sealed housing 20, where an exemplary housing may have an O.D. of about 3¼", containing a transducer section 22, a transformer section 24, and a pressure compensator section 26. The transducer section 22 comprises a plurality of aligned cylindrical transducer elements 28, where adjacent transducer elements are spaced from one another by dielectric spacer members 30. The transducer elements 28 are preferably ceramic, doped with leadzirconate with a silver coating on the inner surface, as well as the outer surface. The respective transducer elements 28 are electrically connected in parallel, see FIG. 3, and energized by the transformer section 24.

The transformer section includes a transformer (preferably 10 to 1 ratio) to step up the voltage applied to the transmission line 31. In a preferred operating system, the transmission line 31 is a coaxial cable, encased in a protective metal shield, extending to an above ground location, such as a logging truck 32. The transmission line is of sufficient length, such as 5000 ft., to reach the desired downhole position, and is arranged coaxially, preferably with a steel armor shield. This shield serves the dual roll of providing strength to bear weight, and providing electrical shielding to prevent electro magnetic (EM) radiation. If desired, additional conductors may be added within the shield to carry monitoring information, such as temperature, pressure, etc.

A second important function of the transformer is to match the impedance to the transmission line 31. The reactance on the secondary of the transformer is typically capacitive. The desired impedance at the primary of the matching transformer is approximately 50±j0 Ω, all resistive, with little or no capacitive or inductive reactance.

The preferred pressure compensator section 26 includes a piston or diaphragm that allows equalization of the pressure of the internal oil within the sealed housing 20, with the ambient fluid pressure outside the sealed housing 20. The function, therefore, is to equalize pressure for the system while not allowing free communication, and hence contamination, between the inside oil and the outside fluid, i.e. oil or gas.

In a preferred operation, the transducer assembly 10 is lowered downhole into a well casing to the desired location, typically several thousand feet below ground level. When positioned, the pressure compensator activates to pressurize the oil medium within the sealed housing 20 to equalize the internal pressure to that of the outside pressure. Thereafter, the transducer assembly 10 is energized at a high frequency, on the order of about 20 kHz. As best seen in the blow-up depiction in FIG. 1, the radiation pattern from the transducer assembly reveals a very narrow, horizontal beam of ultrasonic energy radiating omni directionally. The 3 dB beamwidth is on the order of 2 to 3° wide. This narrow radiation pattern allows the available energy to be focused horizontally for maximum penetration into the surrounding strata.

When this ultrasonic energy is introduced into a medium like oil bearing sand or methane bearing coal veins, three effects occur: (a) liquid degassing, (b) cavitation, and (c) breaking of cohesive bonds. That is, the molecular agitation introduced in the form of sound energy aids in the separation of liquids, gasses and solids, and thus facilitates the flow of oil and/or gas into the well casing, about the sealed housing 20 and up the casing for recovery by means known in the art.

It is recognized that changes, variations and modifications may be incorporated into the system of this invention, particularly by those persons skilled in the art. Accordingly, no limitation is intended to be imposed on the system hereof except as set forth in the accompanying claims.

What is claimed is:

1. A method for the stimulation and production of a hydrocarbon containing substance from a location below the surface of the earth, where said location is in fluid communication, via a well casing, with said surface, said method comprising the steps of a.) positioning a transducer mechanism within said well casing at said location, said mechanism comprising a plurality of axially, spaced apart, circular transducer elements, where said transducer elements are electrically arranged in parallel and electrically excitable to produce a high energy, narrow, radiation pattern of high energy impulses extending laterally from said well casing into said location;

b.) maintaining said transducer mechanism within an oil filled medium at a pressure essentially equal to the area in horizontal proximity to said mechanism; and, c.) energizing said transducer mechanism.

2. The method according to claim 1, wherein said high energy, radiation pattern is horizontally focused within a circular band of between 2 and 3 degrees.

3. The method according to claim 1, wherein said transducer elements are sealed within a pressure controlled housing.

4. The method according to claim 1, wherein said transducer mechanism is energized at a frequency of at least 20 kHz.

5. The method according to claim 1, wherein said well casing includes a series of through holes at said location to facilitate movement of said hydrocarbon containing substance into said well casing.

6. The method according to claim 1, wherein each said transducer element is a piezoelectric substance.

7. The method according to claim 6, wherein said piezoelectric substance is a ceramic.

8. The method according to claim 7, wherein said transducer mechanism is energized at a frequency of at least 20 kHz.

9. The method according to claim 1, wherein adjacent said plural transducer elements are spaced apart by dielectric spacer members.

* * * * *